US006736082B2

(12) United States Patent
Breivik et al.

(10) Patent No.: US 6,736,082 B2
(45) Date of Patent: May 18, 2004

(54) METHOD AND SYSTEM FOR CONNECTING AN UNDERWATER BUOY TO A VESSEL

(75) Inventors: Kare G. Breivik, Tau (NO); Paul Pallesen, Hafrsfjord (NO); Svein Inge Eide, Sandnes (NO); Gosta Nilsson, Uddevalla (NO)

(73) Assignee: Statoil ASA, Stavanger (NO)

( * ) Notice: Subject to any disclaimer, the term of this patent is extended or adjusted under 35 U.S.C. 154(b) by 0 days.

(21) Appl. No.: 10/185,447

(22) Filed: Jun. 26, 2002

(65) Prior Publication Data

US 2003/0005875 A1 Jan. 9, 2003

(30) Foreign Application Priority Data

Jun. 29, 2001 (NO) ..... 2001 3264

(51) Int. Cl.[7] ..... B63B 21/00
(52) U.S. Cl. ..... 114/230.1; 441/3
(58) Field of Search ..... 441/3–5; 114/230.1

(56) References Cited

U.S. PATENT DOCUMENTS 4,347,012 A * 8/1982 Glidden ..... 403/2
5,540,607 A * 7/1996 Breivik et al. ..... 441/5
5,676,083 A * 10/1997 Korsgaard ..... 114/230.1
6,595,154 B2 * 7/2003 Boatman ..... 114/230.12

FOREIGN PATENT DOCUMENTS

NO 151354 5/1980
NO 175418 9/1992
NO 300726 9/1993

* cited by examiner

*Primary Examiner*—Jesus D. Sotelo
(74) *Attorney, Agent, or Firm*—Frommer Lawrence & Haug LLP; Ronald R. Santucci

(57) ABSTRACT

Procedure for retrieving an insertion of an underwater buoy (12, 50) in a well (11) at the bottom of a dynamically positioned vessel (10), at which a pulling line (16, 34) for interconnection with the buoy (12, 50) is lowered through the well (11) and hoisted to the deck (13) of the vessel (10), and the buoy (12, 50) is interconnected with the pulling line (16, 34) and hoisted into the well (11) by use of a winching device (15, 65) on the vessel, comprising the steps of attaching the pulling line (16, 34) to the connection unit (19, 32) on the deck (13) of the vessel (10), to lower the connection unit (19, 32) with the pulling line (16, 34) towards the buoy (12, 50) by use of a hoisting device (18, 30, 39) on the vessel (10) under possible guidance by use of the dynamic positioning system of the vessel, to place the connection unit (19, 32) on a cooperating device (20, 51, 52) on the top of the buoy (12, 50), whereby a terminal end on the pulling line (16, 34) is connected to the cooperating device (20, 51, 52) to release the connection unit (19, 32) from the cooperating device (20, 51, 62), and to hoist the connection unit onto the deck of the vessel (10) by using a hoisting device (18, 30, 39), to position the vessel (10) in such a way that the buoy (12, 50) is positioned vertically below the well (11) and to hoist the buoy (12, 50) into the well (11) by using a winching device (15, 65).

10 Claims, 8 Drawing Sheets

METHOD AND SYSTEM FOR CONNECTING AN UNDERWATER BUOY TO A VESSEL

This application claims priority benefits of Norwegian Patent Application number NO 2001 3264 filed Jun. 29, 2001.

The present invention relates to a method and a system for retrieving and leading of an underwater buoy into a well at the bottom of a dynamically positioned vessel, wherein the buoy by the use of winching device on the vessel is pulled into the well via pulling line connected to the buoy.

Previously known buoy loading system which comprises the underwater buoy which is pulled in and locked in a well in the bottom of a vessel, is the so-called STL-system (STL=Submerged Turret Loading). This system is based on a submerged buoy which comprises of a central unit anchored to the seabed and the other buoyancy part which has a turnable bearing, which is adjusted in shape to fit the shape of the well and to be loosely attached to this.

Figure 1:
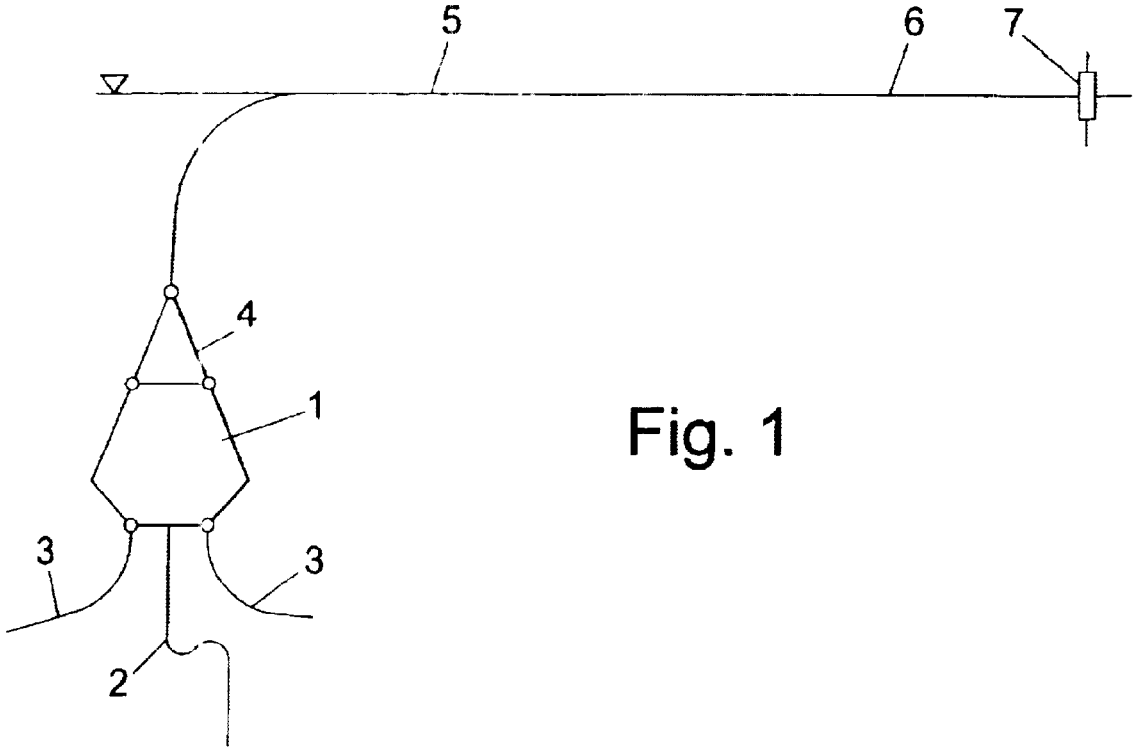

STL-system is today using a floating hawser system consisting of a frontline and a messenger line for connection of the buoy and the current tanker. This known arrangement is shown in FIG. 1 where it is shown a STL-buoy 1 with a riser 2 and with anchor lines for anchoring to the seabed. The buoy is via a crowfoot 4 connected with a hawser/messenger line 5 and a frontline 6 where the free end of the frontline is connected to a marking buoy 7. The floating hawser system 5, 6, which has a horizontal extension of the surface of approximately 200 meters, is normally retrieved by tender vessel. The tender vessel subsequently transfers the frontline to the tanker which pulls in the STL-buoy into the vessel's well by use of a dedicated winching device.

To ensure that a hawser system always shall have a positive buoyancy, it is necessary to use a hawser/messenger line with a special material quality and integration of buoyancy elements.

The known system have the following disadvantages:

- A tender vessel will normally be necessary when the tanker shall connect to the STL-system
- Often it will the tender vessel which due to safety reasons (people who work on the deck) is limiting a connection operation due the weather condition
- The hawser system which is in use today, is costly and require relatively frequent replacements per STL-system per year with normal use)
- It is experienced several times that ships set the floating hawser in the propeller with consequences for both the ship and the field operator The object for the present invention is to provide a method and a system to eliminate the above mentioned disadvantages, and which makes the procedure of connecting a buoy to the current vessel more efficient.

To achieve the above mentioned objectives it is provided a method of the initially mentioned type which according to the invention is characterized by the features which is given in the characterizing part of claim 1.

According to the invention it is also provided a system of the given type which is characterized by the features which is given in the characterizing part of claim 2.

By using the method and the system according to the invention a series of advantages are achieved which can be summarized as follows:

- Tender vessel is not necessary
- Extension of operational limits can be achieved (since the tender vessel today to represents the limitation
- Potential for more efficient operation, i.e. saved tanker time etc.

Figure 2:
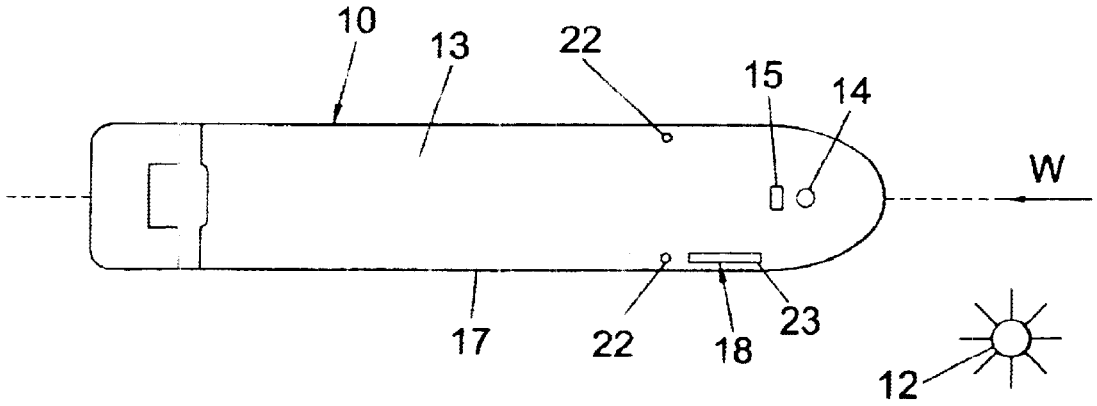
Figure 3:
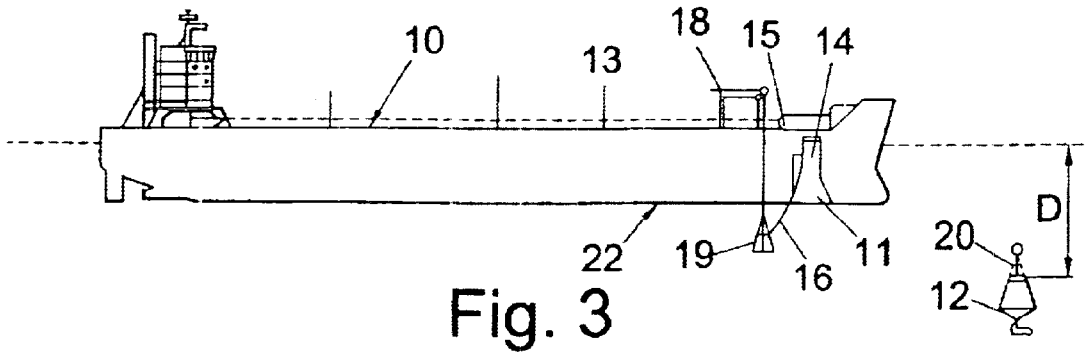
Figure 4:
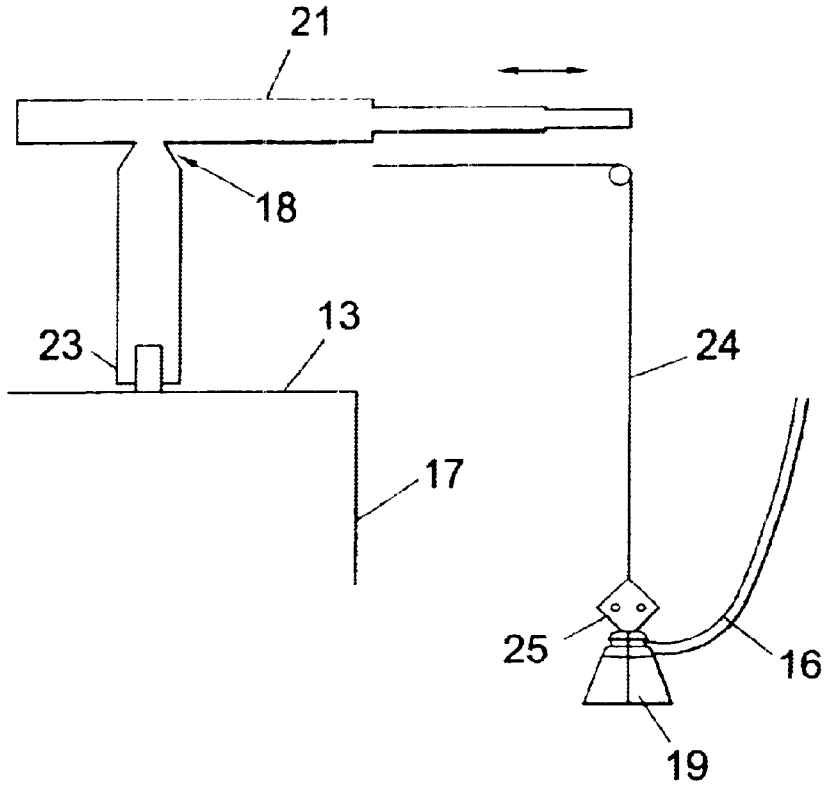
Figure 5:
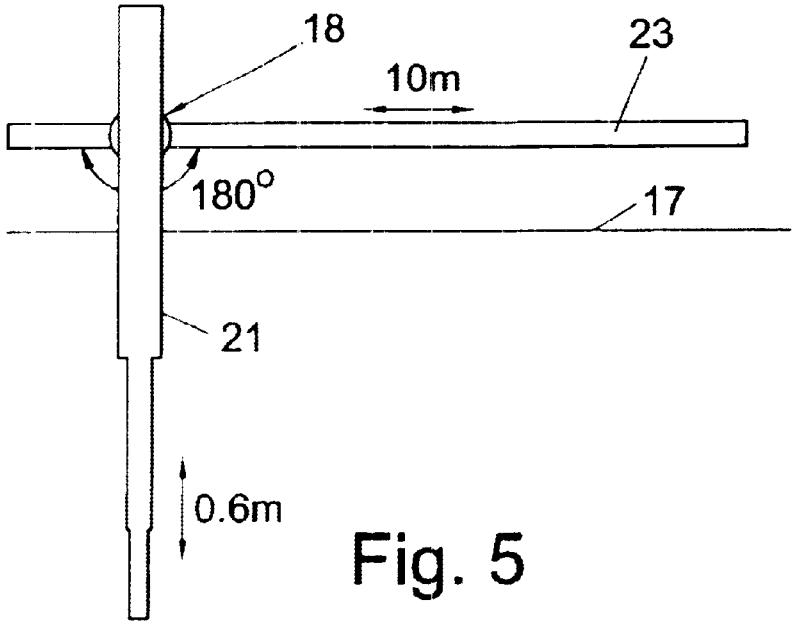
Figure 6:
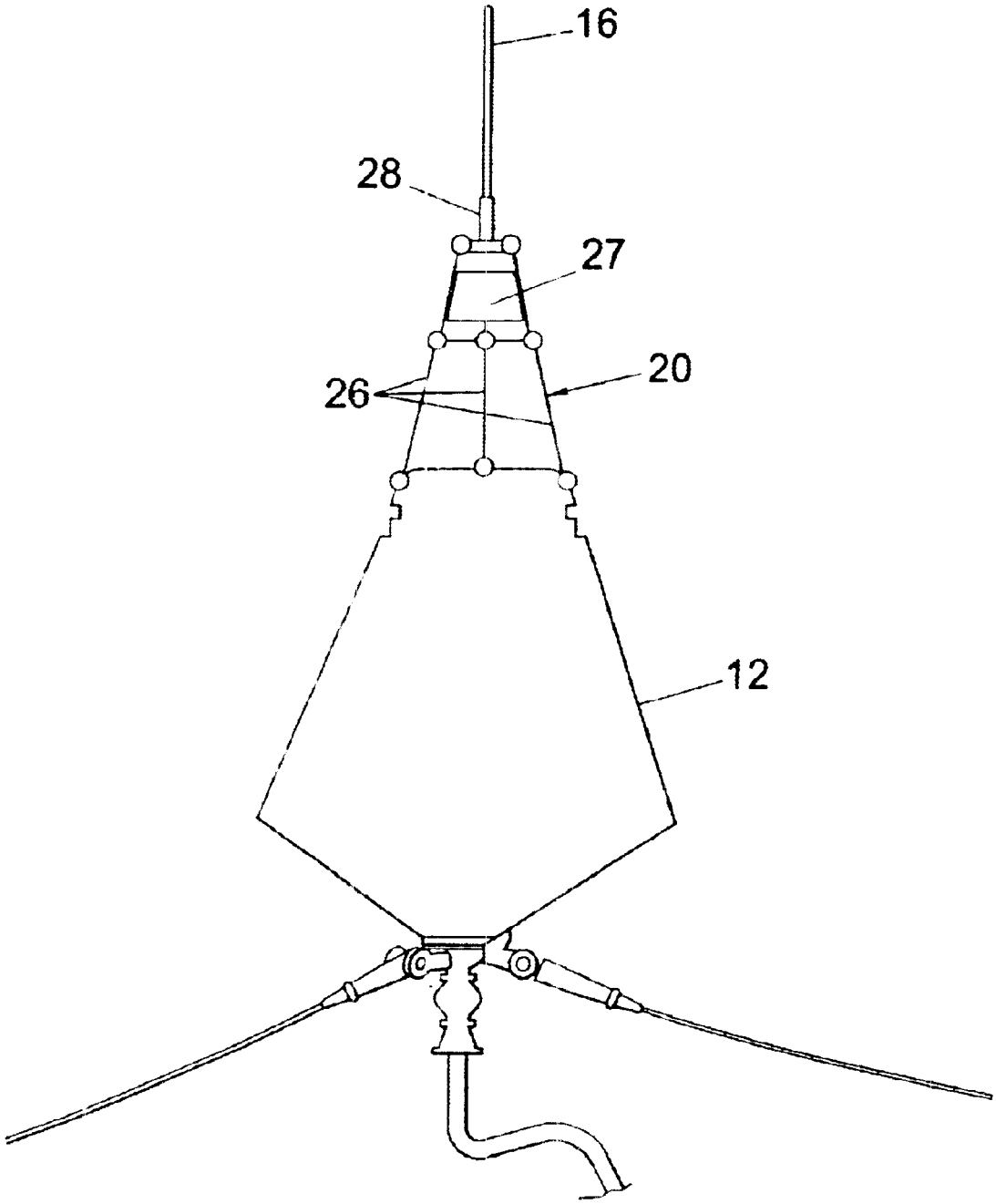
Figure 7:
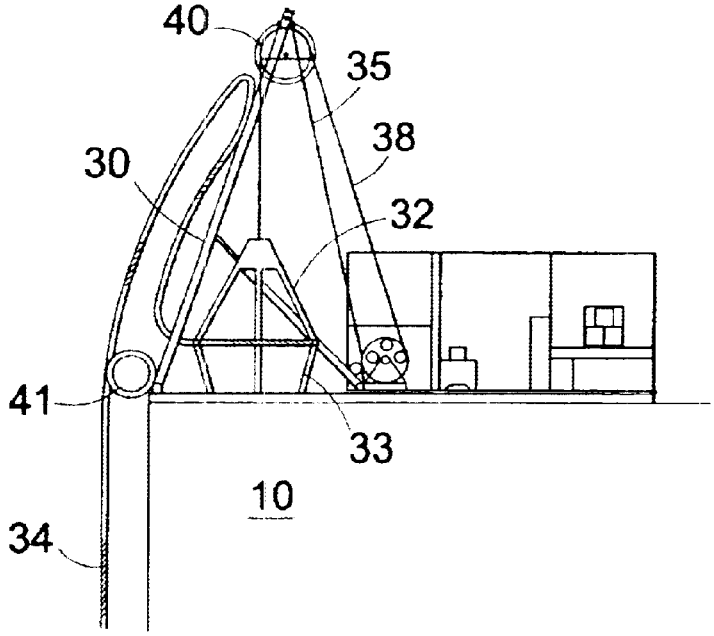
Figure 8:
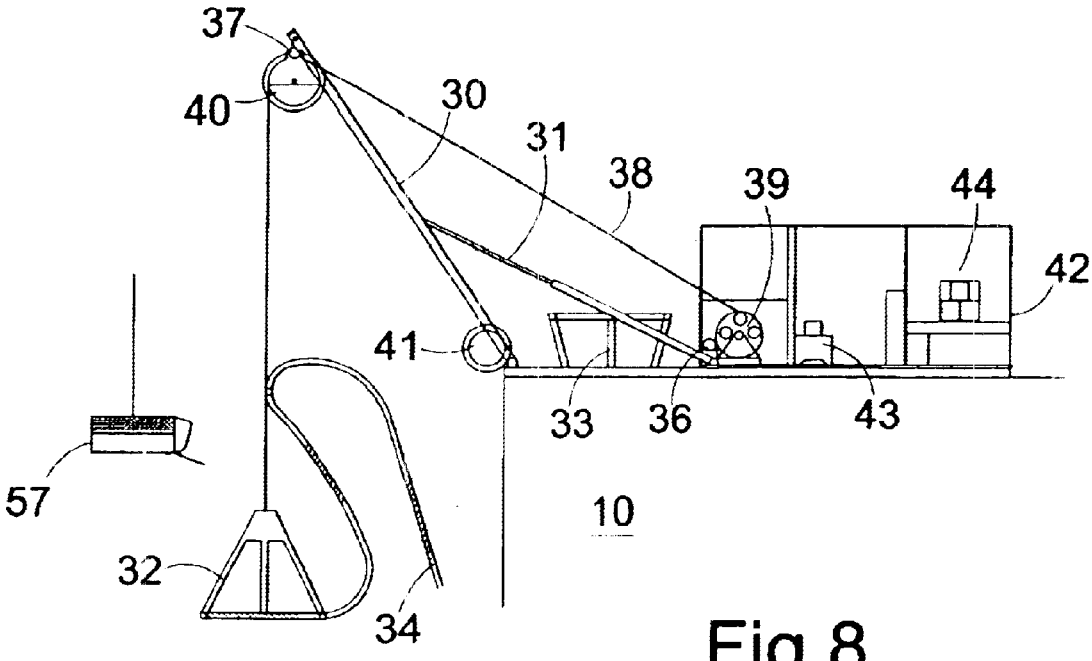
Figure 9:
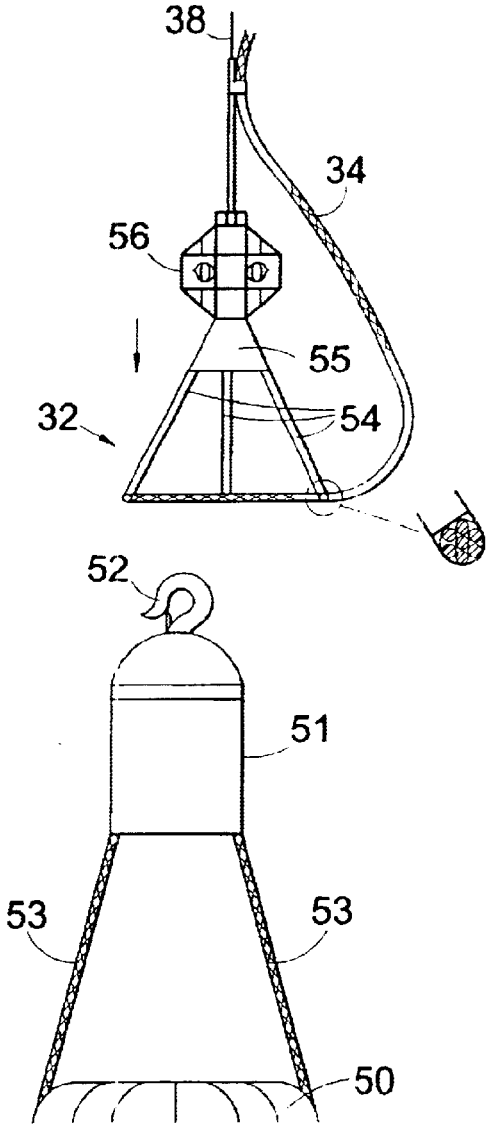
Figure 10:
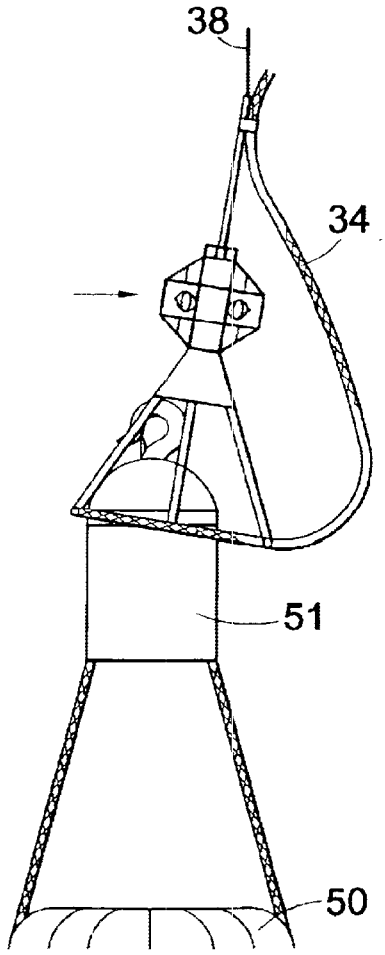
Figure 11:
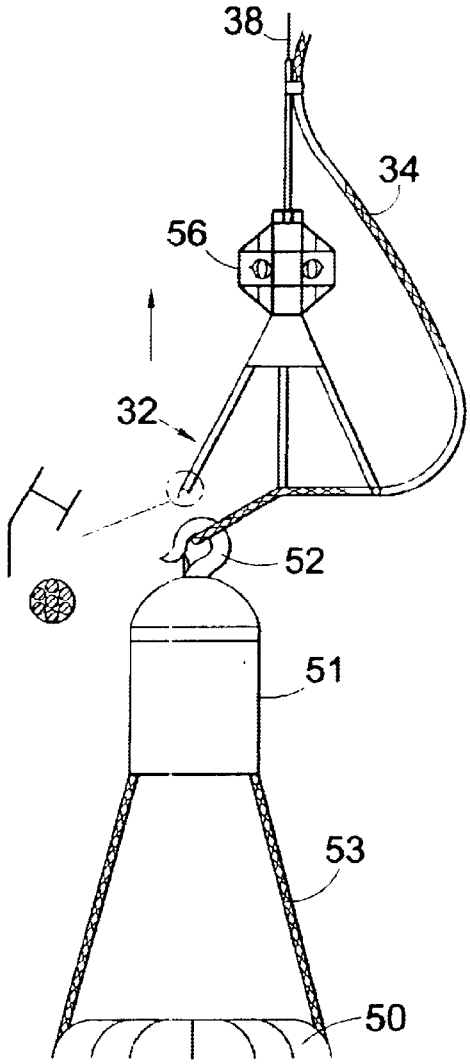
Figure 12:
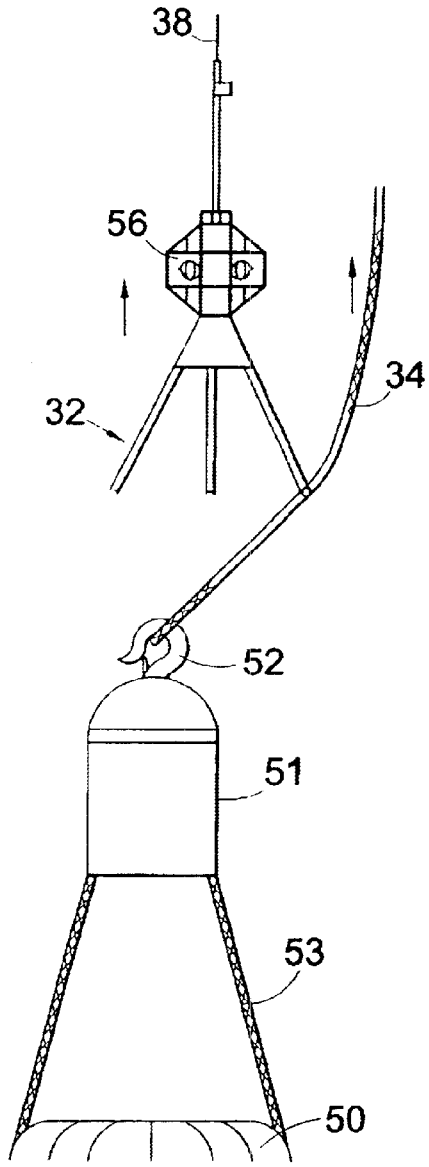

- Reduced maintenance cost (replacement of worn out messenger lines represents today a considerable operational cost)
- No danger for a ship to get the messenger line in the propeller The invention shall be described more closely below in connection with the preferred embodiment with references to the drawings, where FIG. 1 shows the above mentioned, known arrangements for connection of a buoy, FIGS. 2 and 3 shows a bottom view and a side view respectively of a vessel which makes use of the system according to the invention, FIGS. 4 and 5 shows a side view and a bottom view respectively of a crane no and a connection unit which form part of the first embodiment of the system according to the invention, FIG. 6 shows a side view of a buoy which is provided with a device for cooperation with the connection unit on FIG. 4, FIG. 7 shows a side view of a lifting arrangement and a second embodiment of a connection unit for connecting with a buoy, FIG. 8 shows a side view of the lifting arrangement on FIG. 7, in operative position for lowering of the connection unit, FIGS. 9–12 shows different operational phases of the connection between a pulling line and a buoy by use of the connection of the connection unit according to FIGS. 7 and 8, and FIGS. 13–16 shows the different phases of an operational procedure when carrying out the method according to the invention by use of the lifting device and the connection unit according to FIGS. 7 and 8.

On FIGS. 2 and 3 it is shown a vessel 5 in the form of a dynamically positioned shuttle tanker which at the bottom of the vessel's bow section is provided with a well 11 for retrieving and loosely attaching a buoy 12 which in the shown embodiment is assumed to be of the STL-type. The buoy will in praxis be positioned in a fixed geographical position on a depth D below the sea surface on approximately 50 m. The wave direction is on FIG. 2 indicated by "W".

Between the well 11 and the deck 13 of the vessel 10 it is provided a shaft 14, and on the deck near the shaft is provided a winch device 15 for pulling in the buoy 12 into the well 11 by the use of a pulling line 16.

As shown in FIGS. 2–5, it is on one side of the vessel, in the shown example of the side of the vessel 17 on star-board side, installed a crane 18 which is arranged for lowering of connection unit 19 which is adapted for interconnection with an adapted deuce 20 on top of the buoy 12. The crane 18 can be connected to the vessel's dynamic positioning system (DP-system) which give operating signal to the crane so that the lifting beam 21 is positioned correctly in relation to the STL-buoy. For this purpose it can be provided hydro acoustic reference units 22 on the vessel, as shown in FIGS. 2 and 3.

The crane can be moved in the longitudinal direction of the vessel along a crane path 23 with a length of approximately 10 m. The end point of the crane beam 21 can be adjusted transversely to the vessel's direction by designing the beam as a telescopic arm. The telescopic arm can typically be adjusted within an interval from 0 to 6 m. The crane is provided with a heave compensation device The traditional crane wire is here place with a "umbilical cord" 24 (signal cable) which is connected to the connection unit 19 at its end. It can be desirable to install a thruster unit 25 between the umbilical cord 24 and the connection unit 19, as shown in FIG. 4, to be able to carry out precise broadwise positioning of the connection unit when interconnecting with the adapted device of the buoy 20 shall take place.

The adapted device 20 comprises in the shown embodiment of a crowfoot which comprises three equal hawser length 26 which is shackled to the top of the buoy 12 in a pyramid fashion, as shown in FIG. 6. To ensure that the crowfoot 20 has the necessary positive buoyancy, a buoyancy body 27 is provided at the crowfoot's upper end. To the upper end of the crowfoot it is further provided a terminal unit 28 which is arranged for connection and locking to a similar terminal unit at the end of the pulling line 16 of the buoy, as described below.

As shown in FIG. 4, the connection unit 19 is funnel shaped and adapted to the pyramid shape of the crowfoot 20. The connection unit is provided with at least one camera (not shown) and with the necessary instrumentation to carry out the interconnection with the adapted device 20 on the buoy.

The connection unit 19 is arranged in such a way that a terminal end of the pulling line 16 can be placed inside the unit before it is lowered into the sea. When the connection unit is lowered by the use of the crane 18 and placed over the top of the crowfoot 20 of the buoy, the terminal end of the pulling line 16 is locked automatically (i.e. without the use of electric or hydraulic force) to the similar terminal unit 28 at the top of the crowfoot by use of a male/female connection. After the pulling line 16 has been put in position and attached to the crowfoot, the connection unit can be released by the use of an electric operated mechanism, and subsequently be hoisted to the deck of the vessel. Then the buoy can be hoisted into the well 11 in the bow of the ship and be locked in this.

The main points of operation procedure when carrying out the method according to the invention by use of the equipment according to FIGS. 2–6 shall be described in the following.

1. Before the current vessel arrives at the position of the STL-buoy, the pulling line 19 is pulled down through the well 11 and up onto the deck 10 of the vessel where the terminal end of the line is attached to the connection unit 19.
2. The vessel is DP-positioned with the STL-buoy positioned approximately 3 m on the star-board side of the cranes 18 central position in the longitudinal direction.
3. The connection unit 19 is lowered manually by the use of the telescopic crane 18 until it is positioned approximately 1 m of the top of the crowfoot 20. The heave compensation function of the crane is activated.
4. The control of the crane 18 is transferred to the DP-system which will ensure for the connection unit 19 to be positioned within a circle with a radius approximately 2 m in relation to the top of the crowfoot 20
5. Final interconnection can be carried out manually ("joy-stick") or automatic by use of an adapted homing system
6. When interconnection has been carried out, the electric mechanism of the connection unit 19 is activated to release the pulling line 16 terminal end from the connection unit
7. The connection unit 19 can subsequently be hoisted to the deck of the vessel by the use of the crane 18
8. The tanker is repositioned so that the STL-buoy is positioned vertically below the well 11 of the vessel
9. The STL-buoy is hoisted into the well by use of the winch 15
10. When the STL buoy is locked in the well, the terminal unit 28 of the crowfoot 20 can be released from the pulling line 16 terminal unit. This is done manually.
11. When the tanker is fully loaded, the STL-buoy can be disengaged and released from the ship ("free drop")
12. Alternatively the pulling line 16 can be used to lower the STL-buoy controlled out of the ship. In this case the connection unit 19 has to be used to release the pulling line 16 from the crowfoot 20 when the buoy is lowered to a desirable position. Possibly it can be used a hydrodynamic release mechanism which is adjusted for approximately 40 m so that the pulling line is released automatically.

On FIGS. 7 and 8 is shown an hoisting device and a connection unit which is used in the preferred embodiment of the system according to the invention.

The hoisting device comprises of an A-frame 30 which is pivot mounted on a frame at one side of the vessel 10. The A-frame can be maneuvered by the use of an hydraulic piston device 31. A connection unit 32 for interconnecting with the current buoy (not shown) is in FIG. 7 shown to be provided on a preparation bracket 33. A pulling line 34 is loosely attached to the connection unit by use of an arrangement which shall be described below in connection with FIGS. 9–12.

An end section of the pulling line 34 is on FIG. 7 shown to be hoisted to the top of the A-frame 30 by the use of a line 35 which is connected to a preparation winch 36 and runs over a preparation disc 37 at the top of the A-frame. The connection unit 32 is connected with one end of the hoisting line by use of an umbilical cord 38 which with its other end is connected with an active heave compensated winch 39.

The line 38 runs over an umbilical cord disc 40 at the top of the A-frame. At the other end of the A-frame it is provided a roller 41 which the pulling line 34 runs over when lowering the connection unit 32, and when the pulling line is hoisted onto the deck of the vessel as described below.

As suggested in FIG. 8, the preparation winch 36 and the umbilical cord winch 39 is installed inside a protective container 42. The container is also shown to contain inter alia a hydraulic power unit 43 for the A-frame and the winches, and a control unit 44 for the operator of the system.

Different operational phases in connection with interconnecting of pulling line 34 and a buoy by use of a connection unit 32 is shown in the FIGS. 9–12.

As it appears from these figures and partly of the FIGS. 13–16, a current buoy 50 is at its upper end connected with a relatively small additional buoy or book buoy 51, which is at its upper end provided with a hook 52 for connection to the pulling line 34 by use of the connection unit 32. The hook buoy 51 which in the shown embodiment is connected to the buoy 50 by the use of a number of cables 53, is at its lower section provided with ballast (not shown), and in its upper section provided with an buoyancy element (not shown), to ensure that a hook buoy is correctly positioned in the water. The buoyancy elements can suitable be exchangeable, with the consideration that they may be damaged during a connection operation. For the hook 52 to be strong, but at the same time relatively light, it can be made of titanium.

The connection unit 32, in this embodiment, consist of three claw-like rods or legs 54 which in operative position extend downwards from an upper support section 55 and is mutually diverging and form the edges of a thought, regular pyramid In the shown embodiment the connection unit is also provided with a thrusters unit 56, so it can be regarded as a remotely operated vehicle (ROV). As a variance from this embodiment, the connection unit 32 on FIGS. 7 and 8 is not provided with any thruster unit, thus the interconnection with the current buoy will be dependent of assistance from other means, i.e. a separate ROV 57 as shown in FIG. 8.

The pulling line 34 is a hawser, which end section forms a terminal end in the shape of a loop 58 which is suitably dimensioned in relation to the distance between the free ends of the legs 54 so that the loop is maintained in an open, extended position at the legs lower end when it is mounted onto the connection unit 32.

An operational procedure when carrying out the present method when using the device according to FIGS. 7–12 will be described below with references to the FIGS. 13–16.

Figure 13:
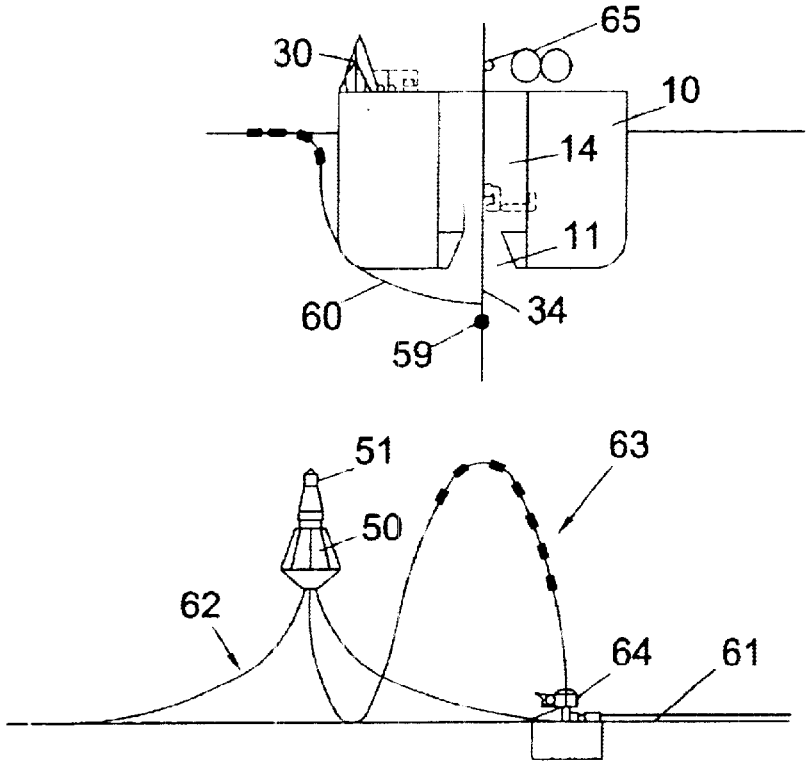
Figure 14:
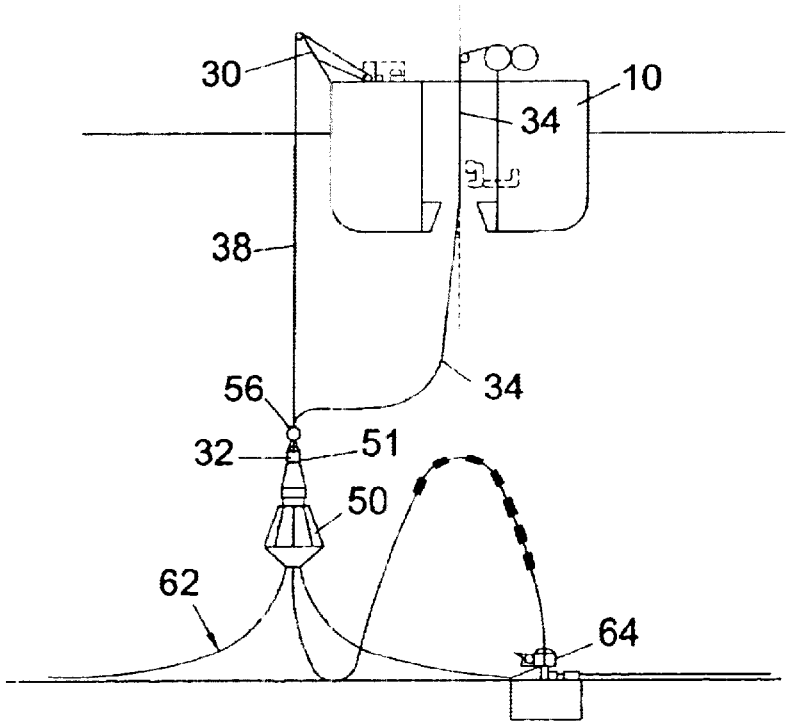

At the beginning of the procedure the pulling line/hawser 34 is lowered with a weight 59 and a floating line 60 down through the shaft 14 and the well 11 in the vessel 10, so that the floating line arise to the surface at the shipside as shown in FIG. 13. The floating line is picked up by the use of the A-frame 30 and the preparation winch 36, and the hawser weight is hoisted to the deck of the vessel. As mentioned above, the hawser end is shaped as a loop 58, and this loop is mounted onto the connection unit 32, so it is kept open by the legs 54 of the connection unit. Then the connection unit 32 is lowered with the hawser 34 into the water by use of the winch 39, as the line/umbilical cord 38, which is connected to the connection unit, runs over the disc 40 at the top of the A-frame.

The connection unit 32 is guided into position by the use of the thrusters unit 56, so that the loop 58 is hooked on the hook 52 on the hook buoy 51, as illustrated on the FIGS. 9–11 and FIG. 14.

Figure 15:
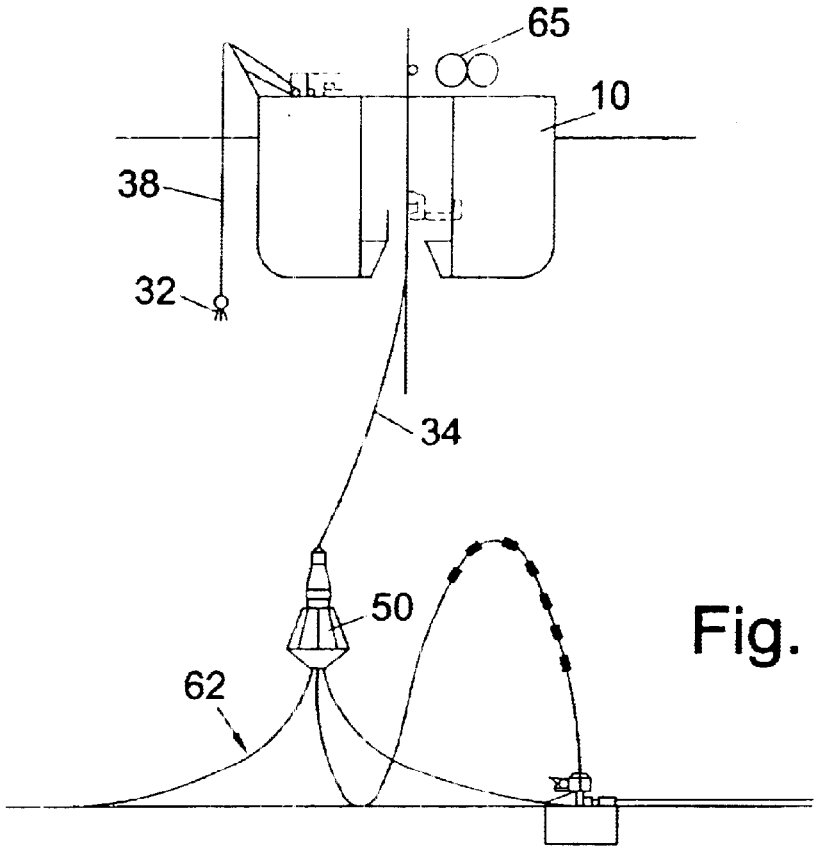
Figure 16:
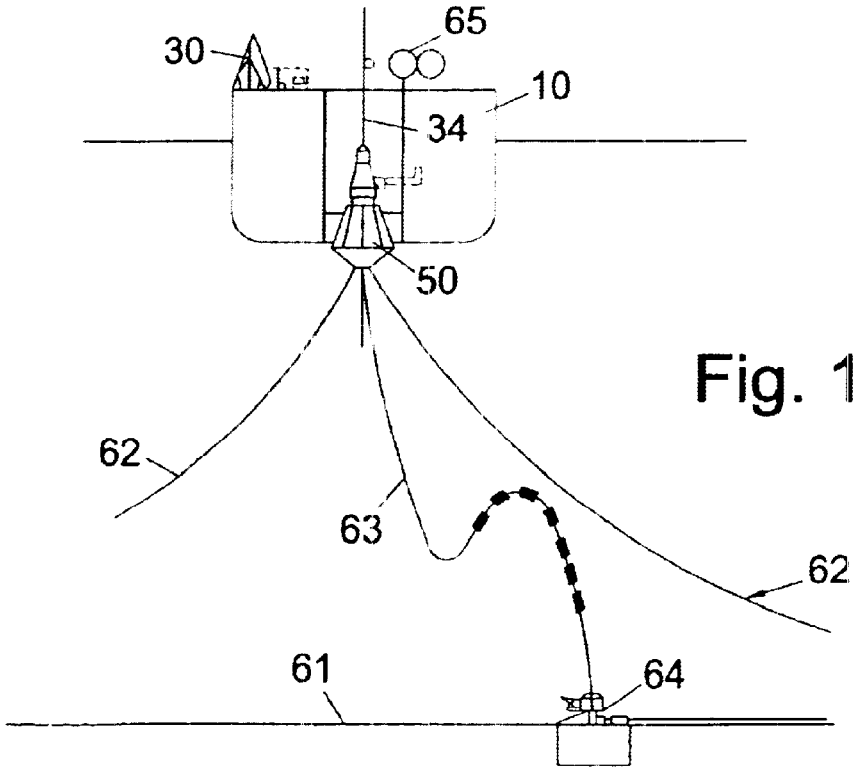

By exercising a suitably upward directed force on the connection unit 32, it is released from the hawser 34, and hoisted to the deck of the vessel as shown in FIG. 15.

Regarding the buoy 50 it is shown to be anchored to the seabed 61 with a number of anchoring lines 62. A flexible riser 63 stretched between the buoy 50 and the wellhead 64 on the seabed.

When the hawser 34 is connected to the buoy, the buoy is hoisted through the water by the use of a winching device 65 on the vessel 10, and the buoy is entered in to the well 11 and locked by use of a suitable locking device.

The connection unit 32 will be heave compensated when the it is close to the buoy 50. The connection unit is made of plastic or composite materials to reduce danger for it to damage the buoy 50 in case of a collision between them.

What is claimed is:

1. A method of retrieving and inserting an underwater buoy (12; 50) in a receiving space (11) at the bottom of a dynamically positioned vessel (10), wherein a pull-in line (16; 34) for interconnection with the buoy (12; 50) is lowered through the receiving space (11) and brought onto the deck (13) of the vessel (10), and the buoy (12; 50) is interconnected with the pull-in line (16; 34) and pulled into the receiving space (11) by means of a winch device (15; 65) on the vessel, comprising the steps of attaching the pull-in line (16; 34) to a coupling unit (19; 32) on the deck (13) of the vessel (10), lowering the coupling unit (19; 32) with the pull-in line (16; 34) towards the buoy (12; 50) by use of a hoisting device (18; 30) on the vessel (10) with or without control of the dynamic positioning system of the vessel, placing the coupling unit (19; 32) on a cooperating device (20; 51, 52) on the top of the buoy (12; 50), whereby an end termination on the pull-in line (16; 34) is connected to the cooperating device (20; 51, 52), releasing the coupling unit (19; 32) from the cooperating device (20; 51, 52) and pulling the coupling unit onto the deck of the vessel (10) by means of the hoisting device (18; 30, 39), positioning the vessel (10) such that the buoy (12; 50) is located vertically below the receiving space (11), and pulling the buoy (12; 50) into the receiving space (11) by means of the winch device (15; 65).

2. A system for retrieval and insertion of an underwater buoy (12; 50) in a receiving space (11) at the bottom of a dynamically positioned vessel (10), comprising a winch device (15; 65) on the vessel for pulling-in of the buoy (12; 50) into the receiving space (11) via a pull-in line (16; 34) attached to the buoy, a coupling unit (19; 32) arranged for connection to a cooperating device (20; 51, 52) on the top of the buoy (12; 50), and a hoisting device (18; 30, 39) arranged on the vessel (10) for lowering of the coupling unit (19; 32) towards the buoy (12; 50) with or without control of the dynamic positioning system of the vessel, the coupling unit (19; 32) being arranged to be connected to an end termination (58) on the pull-in line (16; 34) of the buoy (12; 50), the cooperating device (20; 51, 52) of the buoy being arranged for automatic locking to the end termination of the pull-in line by connecting the coupling unit (19; 32) to the cooperating device (20; 51, 52) of the buoy, and the coupling unit (19; 32) being arranged for guided release from the end termination (58) after said locking to the cooperating device (20; 51, 52).

3. The system according to claim 2, wherein the cooperating device comprises an upwards pointing hook (52) on a hook buoy (51) which is connected to the upper end of the buoy (50), the end termination of the pull-in line (34) being a loop (58) which is adapted for releasable mounting on the coupling unit (32).

4. The system according to claim 3, wherein the coupling unit comprises a holder (55) having downwards extending diverging legs (54) arranged for releasable retention of said loop (58) in a spread-out, open position at the free ends of the legs (54).

5. The system according to claim 4, wherein the coupling unit (19; 32) is connected to the hoisting device (18; 30, 39) by means of an umbilical cord (signal cable) (24; 38).

6. The system according to claim 2, wherein the cooperating device comprises a crowfoot (20) formed by three hawser lengths (26) in a pyramid configuration, and wherein the coupling unit (19) is funnel-shaped and adapted to the pyramid shape of the crowfoot (20).

7. The system according to claim 2, wherein the coupling unit (19; 32) is provided with a propulsion unit (25; 56).

8. The system according to claim 2, wherein the hoisting device comprises a pivotally mounted A-frame (30) and an associated winch device (39).

9. The system according to claim 2, wherein the hoisting device comprises a crane (18) which is provided with a telescopically extendable crane beam (21) and further is displaceably mounted on a craneway (23) extending in the longitudinal direction of the vessel (10).

10. The system according to claim 9, wherein the hoisting device (18; 39) is provided with a heave compensation device.

* * * * *